US005277624A

United States Patent [19]

Champion et al.

[11] Patent Number: 5,277,624

[45] Date of Patent: Jan. 11, 1994

[54] MODULAR ELECTRICAL-CONNECTION ELEMENT

[75] Inventors: Patrick Champion, Change; Jacky Thenaisie, Le Mans, both of France

[73] Assignee: Souriau et Cie, Versailles, France

[21] Appl. No.: 992,596

[22] Filed: Dec. 18, 1992

[30] Foreign Application Priority Data

Dec. 23, 1991 [FR] France ..... 91 16016

[51] Int. Cl.[5] ..... H01R 13/648

[52] U.S. Cl. ..... 439/607; 439/609

[58] Field of Search ..... 439/79, 101, 108, 607, 439/609

[56] References Cited

U.S. PATENT DOCUMENTS

| | | | |
|---|---|---|---|
| 4,655,518 | 4/1987 | Johnson et al. | 439/62 |
| 4,959,024 | 9/1990 | Czeschka | 439/607 |
| 5,104,329 | 4/1992 | Brown et al. | 439/108 |
| 5,176,526 | 1/1993 | Hillbish et al. | 439/108 |

FOREIGN PATENT DOCUMENTS 392629 10/1990 European Pat. Off. .

*Primary Examiner*—Gary F. Paumen

*Attorney, Agent, or Firm*—Bachman & LaPointe

[57] ABSTRACT

The invention relates to a modular electrical-connection element including an insulating body having a U-shaped cross section including a central branch (11) for receiving electrical contact elements and two lateral branches (12,13), said cross section having a width (1) equal to that of a module, characterized in that each lateral branch includes an electrically conductive screening element (40) extending over a major part of an outwardly directed surface of said lateral branch, said screening element including at least one means (46,48) for elastic electrical contact positioned on an inner face of said lateral branch and at least one means for electrical connection through said insulating body, said screening element (40) having a means (45) for retaining said screening element in position in the insulating body, at least in the direction of a pull-out substantially parallel to an axis of the U-shaped cross section.

11 Claims, 10 Drawing Sheets

L1
L2

R
F

I Ob
b

MODULAR ELECTRICAL-CONNECTION ELEMENT

BACKGROUND OF THE INVENTION

The present invention relates to a modular electrical-connection device which may be used especially for producing electrical contacts from a motherboard and/or a daughterboard.

A screened connector intended for interconnecting two printed-circuit boards is known from U.S. Pat. No. 4,959,024 (ERNI). It has a first female connector intended to be mounted on a motherboard and including an outer screen constituted by a U-shaped profile extending over the entire length of the connector and fixed to the motherboard by ends of ground contacts. An insulating central body includes elastic-connection female connectors, a point-shaped end of which is firmly attached to the motherboard. A male connector, carrying a daughterboard and two outer screening portions solidly attached to the daughterboard, is connected by plugging into the first connector in order to interconnect both the contacts of the male and female connectors and their screening elements.

Such an assembly for interconnection between a motherboard and a daughterboard has the following drawbacks:

mounting on the motherboard imposes a two-part assembly operation, namely mounting the screening element on the motherboard and then connecting the actual connector; the connector is not truly modular, given that the screening element occupies the entire length of the connector;

this construction does not favor the implementation of polarizing means, or if the latter are used, they impose an increase in the lateral dimensions of the connector;

the screen of the connector carrying the daughterboard is only fixed to the daughterboard;

the screen of the daughterboard is highly imperfect, given that the two-part screen of the second connector is only effective on one face of the daughterboard.

SUMMARY OF THE INVENTION

The present invention relates to a connection device which can be used especially for producing connections with boards, such as motherboards and/or daughterboards, in which one or more of the aforementioned drawbacks are avoided.

According to a first aspect of the invention, a modular electrical-connection element, in particular for being connected to a daughterboard, may be mounted by a simple plugging-in operation while possessing all the desired connection and screening functions.

For this purpose, the modular electrical-connection element according to the invention is characterized in that it includes an insulating body including a central region for receiving electrical contact elements and two lateral branches substantially perpendicular to an axis of the central region and having a width equal to that of the module, in that each lateral branch includes, on an outer face, a screening element extending over a major part of its surface, the screening element comprising at least one means for retaining in position in the insulating body, at least one electrical connection means emerging on said insulating body, and at least one means for elastic electrical contact through at least one corresponding opening of the lateral branch emerging on an inner face of the lateral branch.

Given that the screening element is disposed on the outside of the insulating body and that the contact engagement is effected via the inside, the inner faces of the lateral branches are released and can be used for implementing polarizing means known per se, for example from European Patent Application EP-A-392,629 (DU PONT DE NEMOURS B.V.).

The screening element can be extended over virtually the entire width of the corresponding outer face. In fact, it is not necessary, when the modular elements are aligned by juxtaposition, for the screening elements to touch. It is sufficient that they are adjacent to the rows of contacts, preferably over the entire length of the latter.

The screening elements may be disposed in recesses of the corresponding outer faces.

The means for elastic electrical contact advantageously includes at least one lever located in a distal region of the corresponding lateral branch. The screening element may then include a stiffener element located in the prolongation of said lever, in a proximal region of the lateral branch.

According to a preferred embodiment, the distal end of the lever has a crook directed toward the inside of the insulating body.

The means for elastic electrical contact may be such that, in the rest position, it extends through the opening, passing beyond the inner face toward the inside of the insulating body.

The means for retaining a screening element in position in the insulating body may consist of at least one tongue of the screening element interacting with at least one groove of the insulating body, especially by forcing the tongue into the groove, and/or a hot-deformable stud.

According to an advantageous embodiment, the contact elements are male contacts, and the central region and the lateral branches form a flattened U-shaped profile. Such a modular connection element can be used both as a male connector, by mounting male contacts on the latter by forcible mounting, or else as a bridging element fixed to an opposite end of the motherboard and traversed by the ends of the male contacts of a male connector sliding into the openings of the bridging element. Such a bridging element is capable of receiving a female cable connector.

A plurality of modular elements such as defined hereinabove may be mounted side by side, firmly attached to a printed-circuit motherboard, at least one connector having contacts interacting electrically with the contact elements of a modular element as well as an outer screening element arranged so as to interact electrically with the electrical contact means of the screening element. The outer screening element may include at least one prolongation extending in the direction of the central branch of the insulating body of the modular element and running along the inner face of a lateral branch so as to permit a ground-contact continuity as the contact elements of the connectors and of the modular element are in electrical contact.

According to a second aspect, the invention relates to a modular electrical-connection element which can be used both as a male connector, when it is equipped with male contact elements, or as a bridging element for connecting between a motherboard and, for example, a cable connector, and which can be fixed simply to the motherboard.

A modular element according to the second aspect of the invention is of the type including, as is known from U.S. Pat. No. 4,655,518 (TERADYNE INC), an insulating body having a flattened U-shaped profile having a central branch for receiving electrical contact elements and two lateral branches which have, in a direction perpendicular to the plane of the U-shaped profile, a width equal to that of the module. According to the invention, it is characterized in that each lateral branch includes a screening element extending over a major part of its surface, the screening element including at least one means for elastic electrical contact on an inner face of the lateral branch and at least one means for electrical connection through the insulating body, the screening element having a means for retaining it in position in the insulating body, at least in the direction of a pull-out substantially parallel to an axis of the U-shaped profile.

The presence of a screening element firmly attached to the insulating body is thus advantageous for fixing the insulating body to a motherboard, when there is a bridging element, or for reinforcing the fixing of a male connector to a motherboard.

The means for retaining in position may include at least one tongue folded over by substantially 90° with respect to the plane of the screening element and interacting with at least one groove of the insulating body. This tongue-groove interaction permits an excellent transmission of the forces when the modular element is subjected to pull-out forces. The interaction may, in particular, be obtained by forcing the tongue into the corresponding groove. The groove may be disposed substantially at the junction between the central branch and the corresponding lateral branch, that is to say in a region close to the means for electrically connecting the screening element and which have good rigidity locally.

The modular element is mounted particularly easily when the means for electrically connecting the screening element includes at least one connection tab of the forcible-insertion (press-fit) type.

The screening elements may have an edge adjoining the central branch of the central body and including a plurality of the connection means alternating with a plurality of said tongues.

The electrical connection device according to the invention may include a first assembly of modular elements such as defined hereinabove, the first assembly being, for example, constituted by bridging elements for a cable connector firmly attached to the motherboard solely by the electrical connection means, the modular elements being mounted side by side and firmly attached to a motherboard at least by said electrical connection means. A second assembly may be constituted by male connectors mounted back to back with the bridging elements of the first assembly, the electrical connection means of the first and of the second assembly being fitted together.

According to a third aspect, the invention relates to a connector having an insulating central element including rows of connection elements having a first male terminal intended to be solidly attached to a flat support, such as a daughterboard, and a second terminal, especially a female terminal, as well as a screening device disposed on either side of the rows of connection elements. In the aforementioned U.S. Pat. No. 4,959,024, the screening element of such a connector is in two parts which are fixed only to the daughterboard, the opposite end being retained in position when the connector is mounted.

According to the invention, this drawback is to a large extent remedied by the fact that the connector is characterized in that it includes at least one hot-deformable stud firmly attached to the central element, in that the screening element has a portion provided with at least one opening, the shape of the screening device being such that, when it is mounted on the connector, the opening engages in the stud and a space intended for receiving one end of the support is left between said portion and the central element. As a result, the screening element is firmly attached both to the daughterboard and to the central element of the connector.

The central element may include at least one centering element disposed in the vicinity of the stud and intended for positioning the flat support, especially during the hot deformation of the stud.

The connector according to the invention is, for example, of the type in which the connection elements include a right-angle bend. In this case, the portion is advantageously disposed at one end of the screening device adjacent to the second terminals of a row of connection elements. When plugging in the connector into the modular connection element, the opening is located in the overlap zone between the screens, as a result of which the opening or openings introduce no interruption in the screen.

The screening device may include, on one face of the insulating central element opposite the portion, at least one prolongation extending substantially as far as a distal end of the female terminals.

The screening device may be in two parts intended to be connected to the support by means of fitted-together contacts.

The invention also relates to a connection device including a connector as defined hereinabove mounted on the flat support, such as a printed-circuit daughterboard, characterized in that the male terminals of the connection elements are firmly attached to the support and in that the end of the support includes at least one opening traversed by the stud and is sandwiched between the portion of the screening device and the insulating central element, by at least one the stud forming a rivet in its post-deformation state.

At least one centering element may be carried by the central element and be mounted with clamping in the flat support. Thus, the flat support is retained in position, the position being preserved even during the hot deformation of the stud.

The screening device may then include first and second parts located on two opposite sides of the flat support. The first part of the screening device may then include a cap disposed around the male terminals and having a first end including contacts by means of which it is fixed to the flat support and a second end constituted by the portion. The second part of the screening device may include a first end including contacts by means of which it is fixed to the flat support in a fitted-together manner with the contacts of the first end of the first part and a second end forming at least one prolongation extending substantially as far as a distal end of the second terminals.

BRIEF DESCRIPTION OF THE DRAWINGS

Other characteristics and advantages of the invention will become clearer on reading the description which follows, given by way of non-limiting example, in conjunction with the drawings which show.

DETAILED DESCRIPTION

Figures 2A, 2B, 2C, 2D, 3A, 3B, 3C, 3D:
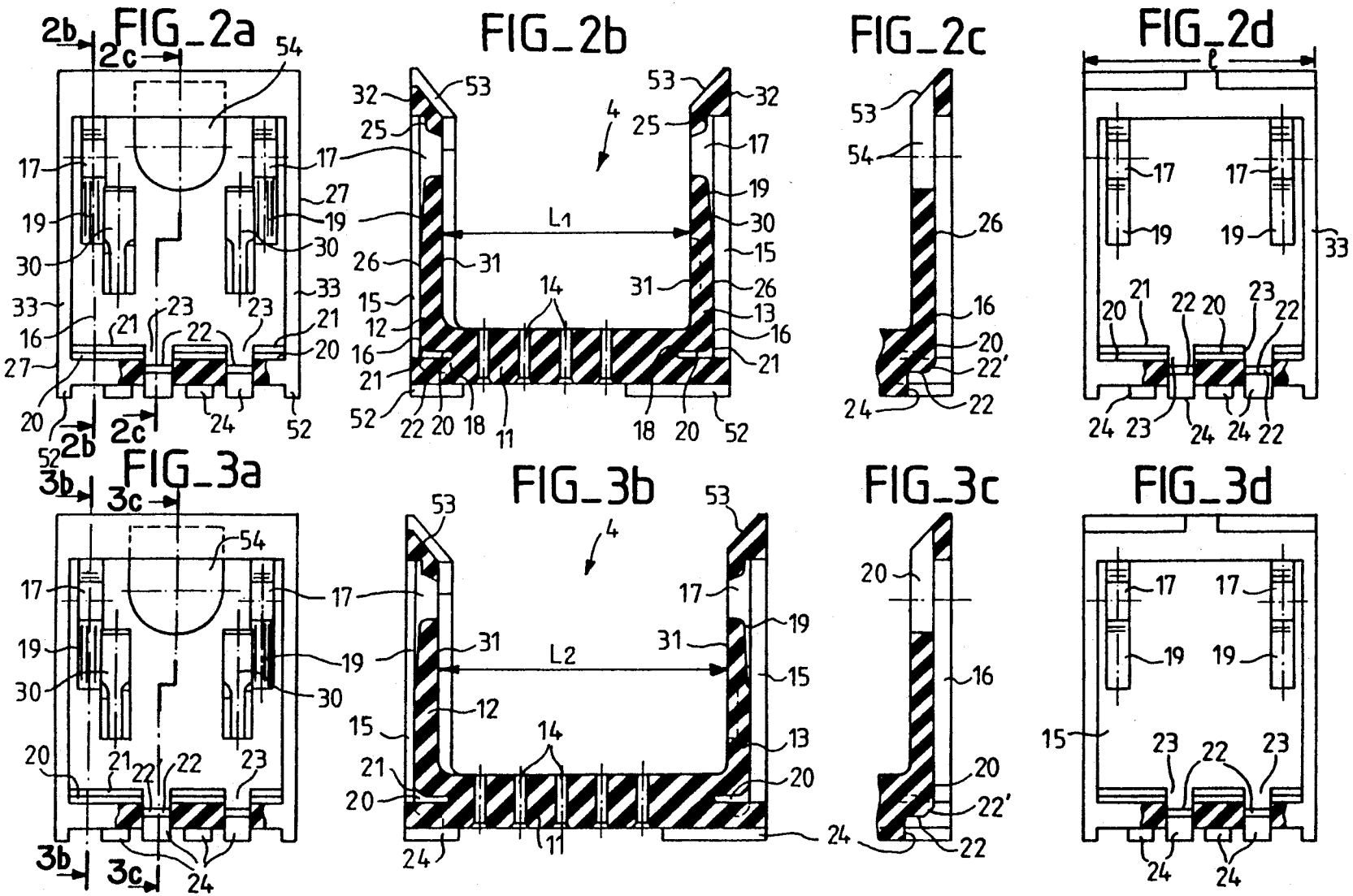
FIGS. 2*a* to 2*d*, respectively in a view from the right with partial removal, in a sectional view along A—A, in a sectional view along B—B and in a view from the left with partial removal, an insulating body having four rows of conductors according to the invention.
FIGS. 3*a* to 3*d*, respectively in a view from the right with partial removal, in a sectional view along A—A, in a sectional view along B—B and in a view from the left with partial removal, an insulating body having five rows of connectors according to the invention.
Figures 4A, 4B, 4C, 4D, 4E:
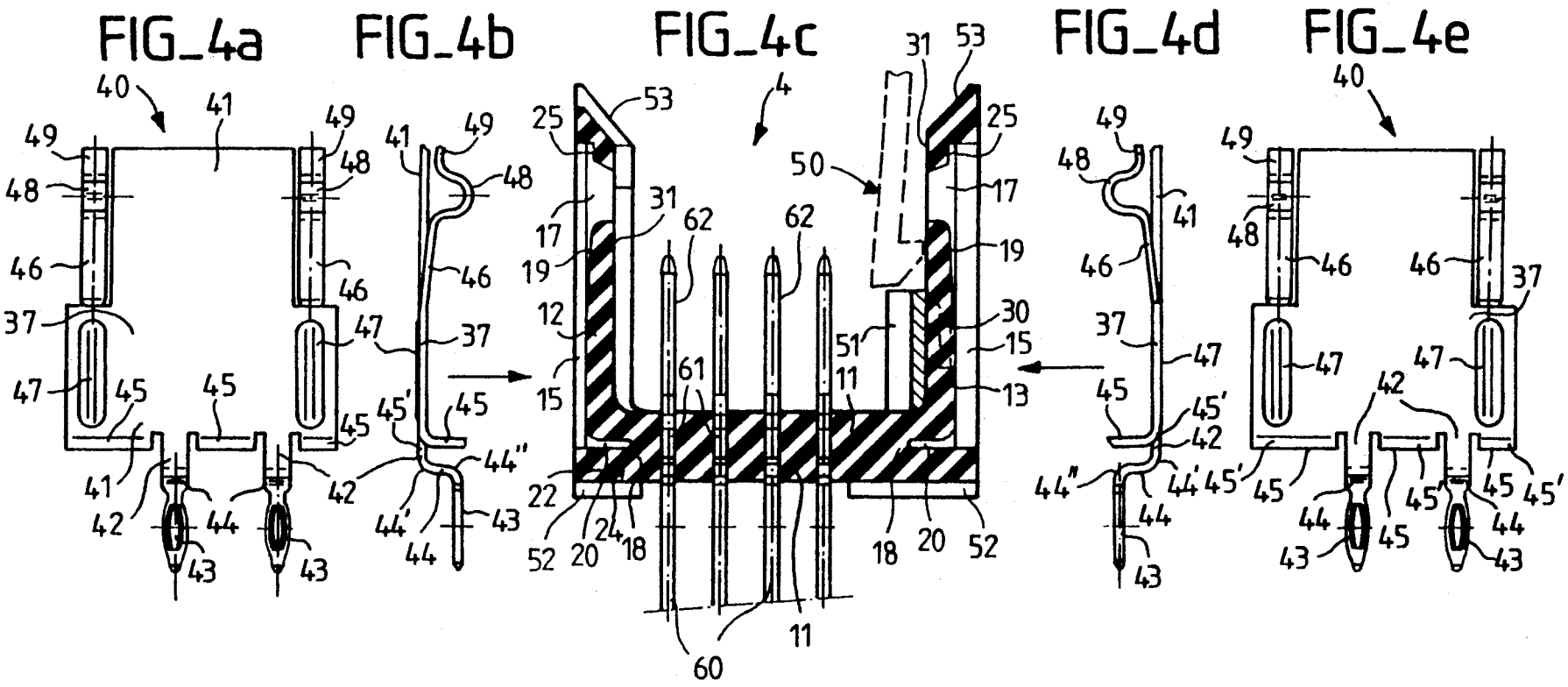
FIGS 4*a* to 4*e* represent, respectively, a first screening plate in front view, the first screening plate in side view, a male connector in cross section, a second screening plate in side view and the second screening plate in front view.

According to FIGS. 2*a* to 2*d*, an insulating body, designated by the general reference 5, has a flattened U-shaped profile including a central branch 11 provided with openings 14 intended for receiving electrical contacts and two lateral branches 12 and 13. Such a disposition is known per se from U.S. Pat. No. 4,655,518 for receiving male contacts. The branch 13 includes polarizing and/or catching grooves 30 emerging on its inner face 31. The outer faces 32 of the branches 12 and 13 each have a recess 15 of rectangular general shape, the width of which is virtually equal to the width 1 of the corresponding branch except for two marginal strips 33. The recesses 15 extend up along the branch as far as the contact passage opening 17 located at the distal end of the branches 12 and 13. The bottom 26 of the recesses 15 includes a plane lower part 16, an upper middle part forming an inclined plane 19 for connecting with the opening 17 and, beyond the opening 17, a limit stop 25. At the junction 18 between the lateral branches 12 and 13 and the central branch 11, the bottom 16 of the recesses 15 is connected with grooves 20 disposed in the direction of the width of the branch, by means of chamfers 21. FIG. 2*c* shows housings 54 for hot-deformable studs. Each housing 54 is located between the openings 17 at the distal end of the branches 12 and 13. Furthermore, as FIG. 2*c* also shows, the lower part 16 of the bottom 26 of the recess 15 is also prolonged, via chamfers 22' by two narrow profiles, one horizontal 22 and the other vertical 24, these being located below the grooves 20 and alternating with the latter.

The lateral edges 27 of the lateral branches 12 and 13 are prolonged by spacers 52, the lower part of which is located in the same plane as the lower part of the profiles 24. Finally, the distal ends of the branches 12 and 13 have entry chamfers 53.

FIGS. 2*a* to 2*d* show four rows of holes 14 corresponding to a connection of the 4+2 type (4 connection elements+2 rows of screening) with a central branch of width $L_1$, whereas FIGS. 3*a* to 3*d*, identical elsewhere, have a wider central branch 11 (width $L_2$) and having five rows of opening 14 corresponding to a connection of the 5+2 type.

Figure 5B:
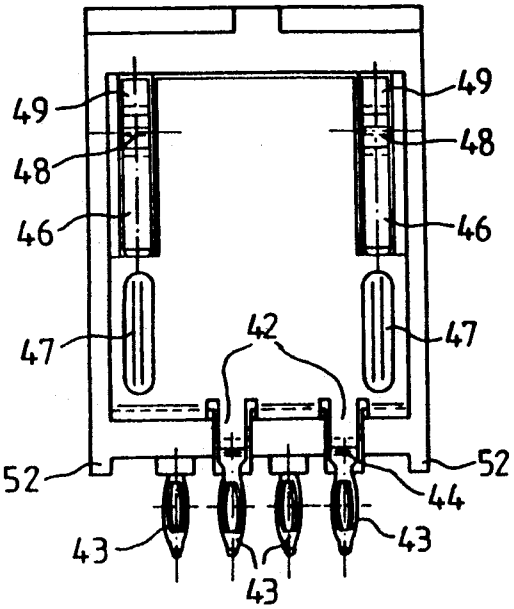
FIGS. 5*a* to 5*c*, a male connector according to the invention assembled with two screening plates, respectively in cross section, in side view and in plan view.
Figure 5C:
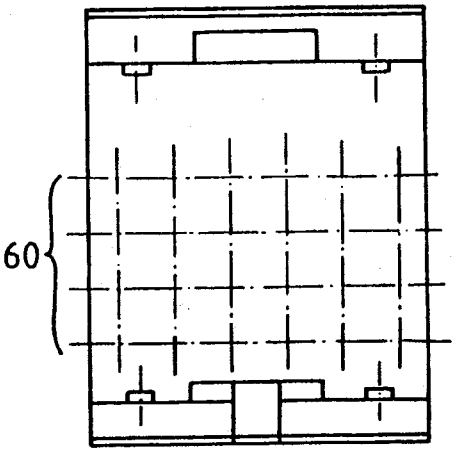
Figure 5A:
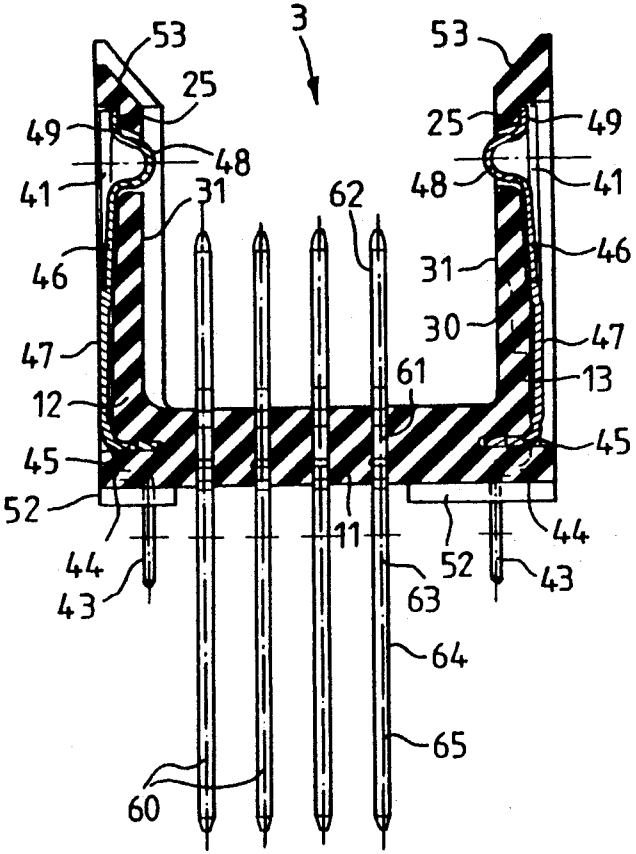

FIGS. 4*a* to 4*e* show a male connector 3 in which male electrical contacts 60 have been forcibly mounted into the openings 14 of the central branch 11 and which is ready to receive, in its lateral branches 12 and 13, screening plates designated by the general reference 40. A screening plate 40 includes a base plate 37 being prolonged by a narrower upper plate 41 and having, on either side, contact arms 46 which are connected to the base plate 37. Each of the contact arms 46 includes a part inclined at an angle corresponding at rest to that of the inclined part 19 and being prolonged by a crook 48, the dimensions of which correspond to those of the opening 17. The crook 48 is itself prolonged by an end 49 intended to interact with the limit stop 25. The base plate 37 includes, in the prolongation of the contact arms 46, two incurvate mechanical reinforcements 47. The upper part 41 of the base plate 37 has, on the one hand, three tongues 45 folded over at 90° at 45' in the direction of the crook 48 so as to interact with the corresponding grooves 20, the tongues 45 alternating with two male contact elements 42 having ends 43 which may be forcibly inserted or press fitted into a board. The two male contacts 42 have two alternating 90° folds at 44' and 44'' defining a recessed horizontal portion 44 intended to be housed in the horizontal face 22, the corresponding end 43 arriving in the prolongation of the vertical face 24. As FIGS. 4*a* to 4*e* show, the male connector 3 receives two identical screening plates 40. They are fixed, in the direction of the arrows of FIG. 4*c*, to its lateral branches 12 and 13 as shown in FIGS. 5*a* to 5*c*. FIG. 5*b* shows the positioning of the male contacts 43 which is laterally offset, which produces, in side view, alternate contacts and which will result, as will be seen hereinbelow, in a fitted-together mounting in the same plane for a back to back assembly of a male connector and a bridging element on a motherboard. On the motherboard, the male contacts 43 of the male connector and of the bridging element are interconnected. The tongues 45 are forcibly inserted or press fitted into the grooves 20, which enables the screening elements to be retained in place in the male connector and therefore a modular element to be produced which can be mounted onto a board in a single insertion operation. It will also be noted that the housing 54 enables, by virtue of its deformable stud, the plate 41 to be retained in place during flexions of the arms 46.

Figure 1:
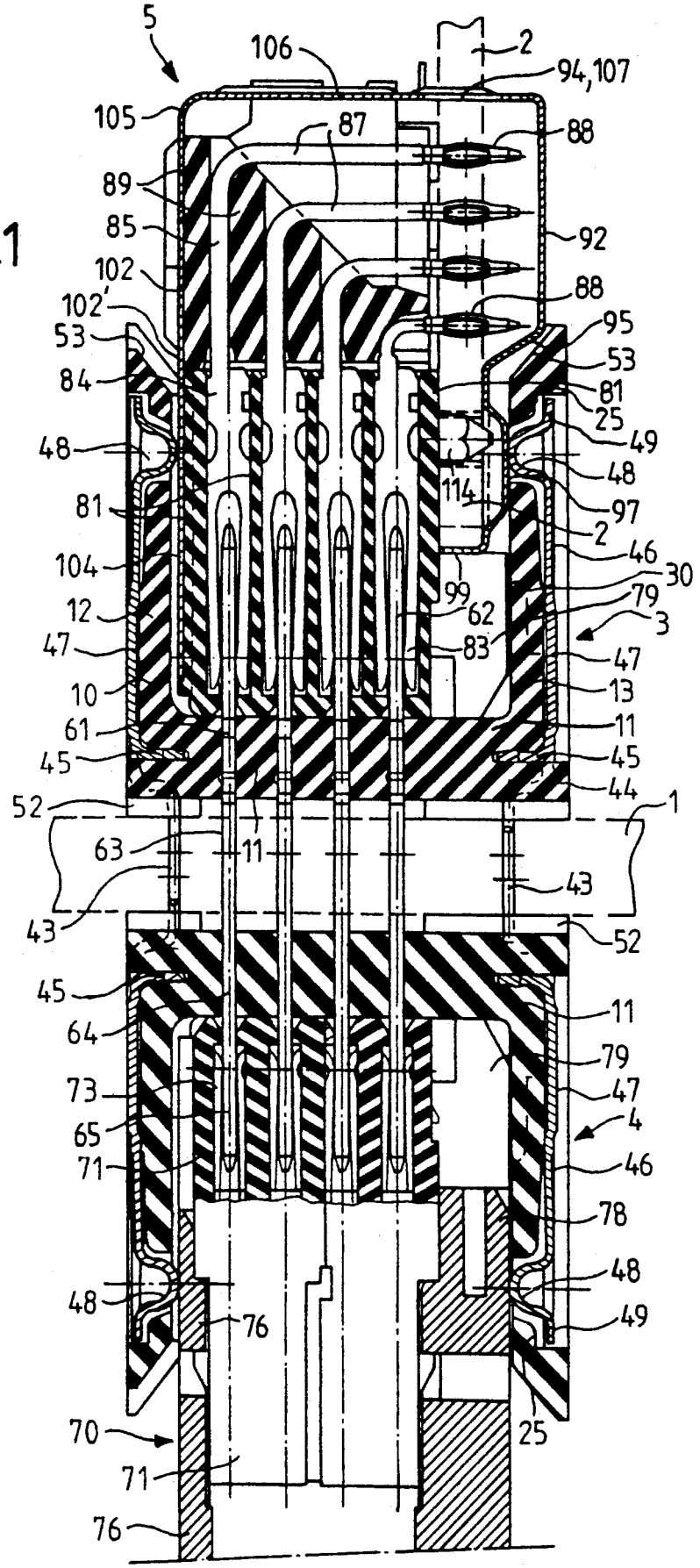
FIG. 1, an interconnection assembly between a motherboard, a daughterboard and a cable connector and including an assembly of connection elements according to the invention, namely a male connector, a female connector and a bridging element for receiving a cable connector known per se.

In FIG. 5*a*, the levers 46, in the rest position, follow the inclined profile 19 in their distal parts, the crook 48 of the edges of the internal faces 31 of the lateral branches 12 and 13 and their ends 49 bear on the corresponding limit stops 25. The thickness of the lateral branches 12 and 13 thus advantageously absorbs the movement of the elastic contacts 46 (see FIG. 1).

Figure 7:
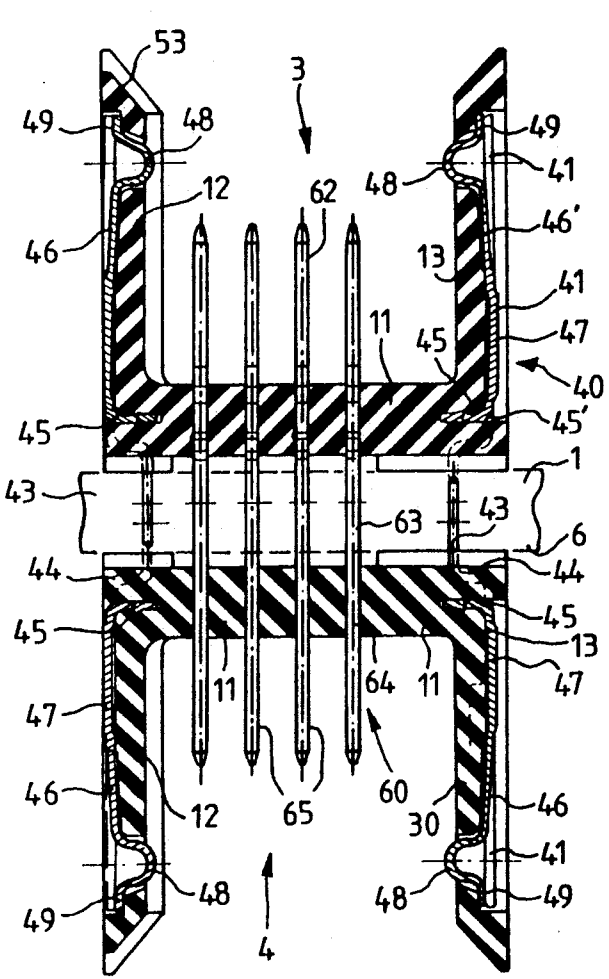
FIG. 7, a cross-sectional view of a male connector mounted on a motherboard back to back with a bridging element according to the invention.
Figure 6B:
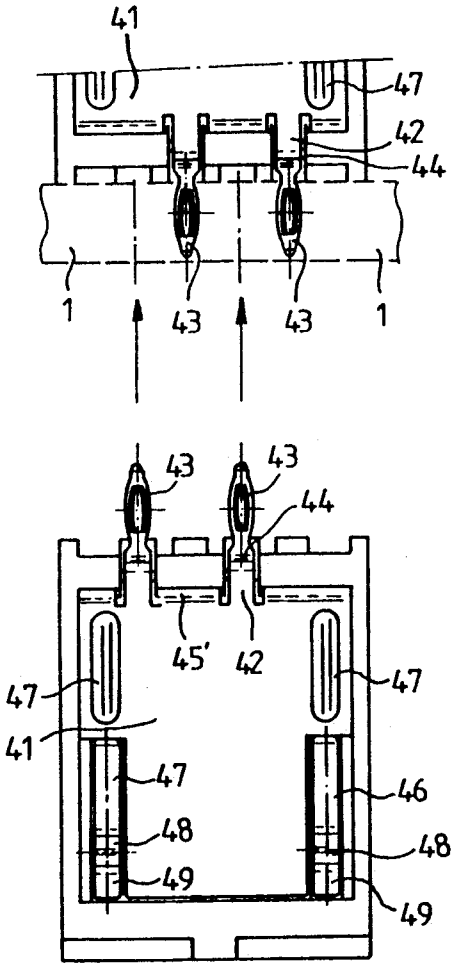
FIGS. 6*a* to 6*b*, respectively in cross section and in side view, a male connector according to the invention mounted on a motherboard before assembly with a bridging element.
Figure 6A:
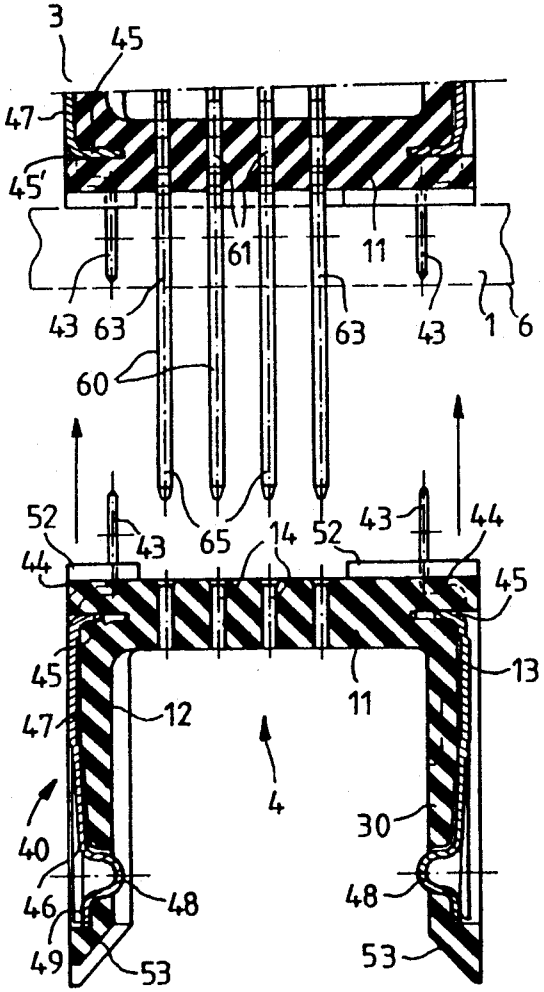

The electrical contacts 60 have an active part 62 located inside the U-shaped profile of the male connector 3 and, since they are solidly attached at 61 to the central branch 11, they may be inserted into a motherboard 1 at the same time as the contacts 43 according to the forcibly-insertion technique called "press-fit" (FIGS. 6*a* and 6*b*). In this embodiment, the male connectors also have ends 64 and 65 which extend beyond the lower face 6 of the motherboard 1 in order to interact with a bridging element 4 capable of receiving a cable connector. The bridging element, designated by the general reference 4, is constituted by an insulating body 5, as shown in FIGS. 2*a* to 2*d* or 3*a* to 3*d*, in which two screening and connecting plates 40 have been added as shown in FIGS. 4*a*, 4*b*, 4*d* and 4*e*. The openings 14 of the bridging element 4 slide freely along the end 65 of the male contacts 60 until butting up against the lower face 6 of the motherboard 1, the bridging element 4 being solidly attached to the motherboard solely by male contacts 43 forcibly inserted or press-fitted [lacuna] corresponding openings of the motherboard 1. FIG. 6*b* shows the fitted-together position, in the same plane, of the contacts 43 of the bridging element 4 and of the male connector 3 which are mounted back to back. This fitted-together mounting is favorable for good screening. FIG. 7 shows, in sectional view, an assembly including a male connector, a motherboard and a bridging element after back to back assembly. The active ends 65 of the contacts 60 extend toward the inside of the U-shaped insulating body of the bridging element 4 in order to interact with a cable connector. It will be noted that the forcible insertion of the contacts 43 is effected by splaying out the recessed horizontal portion 44 over the horizontal face 22. This makes it possible, because of the limit-stop effect provided by the faces 22, to prevent the forces of insertion of the contacts 43 from being retransmitted to the base plate 37 and thus to prevent it being deformed.

Figures 8A, 8B, 8C:
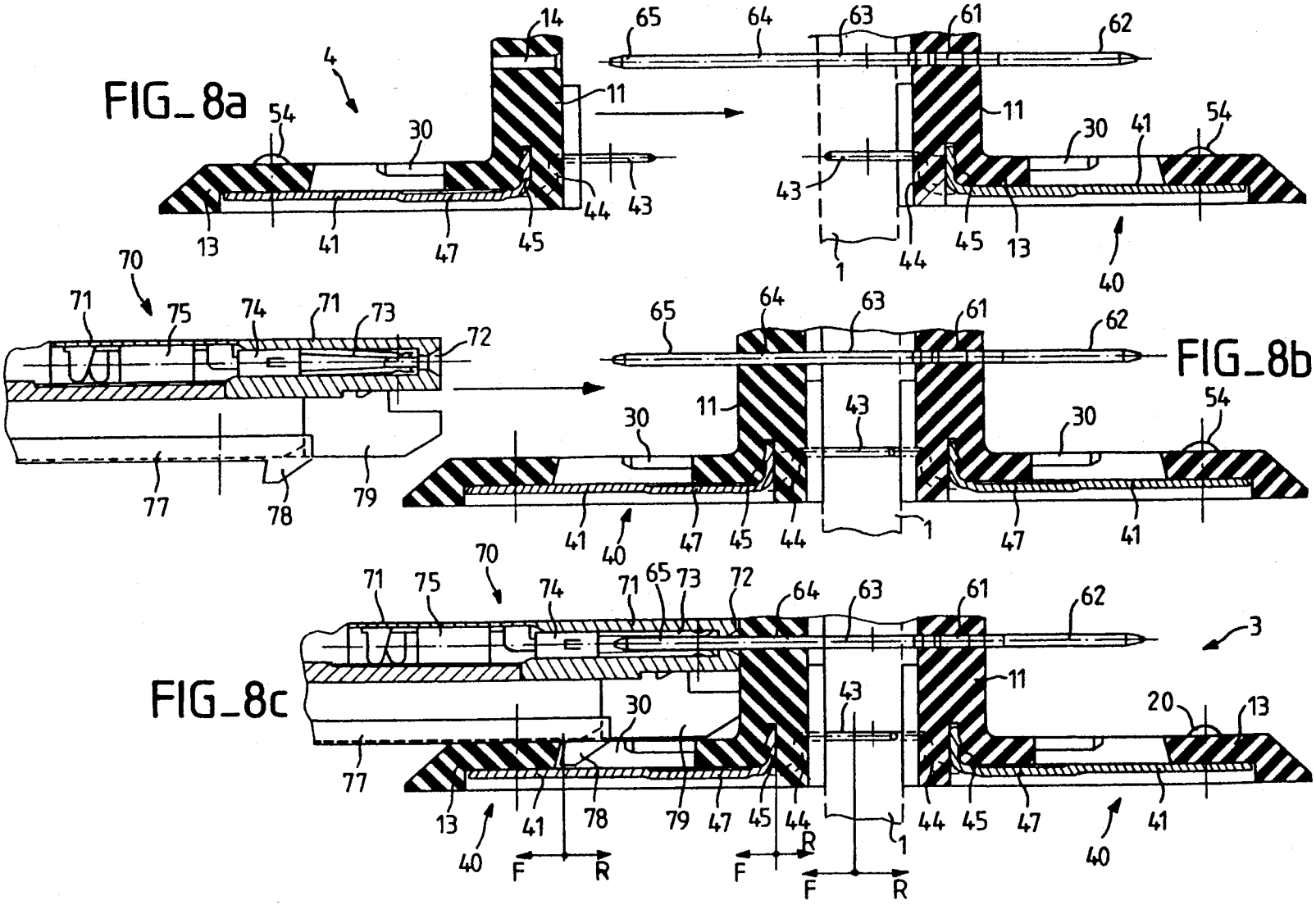
FIGS. 8*a* to 8*c*, in partial cross section, respectively a bridging element before its mounting on a motherboard head to tail with a male connector, the bridging element firmly attached to the motherboard to which a cable connector is presented, and the cable connector interlocked with the aforementioned bridging element.

This is shown in FIGS. 8*a* to 8*c*. The sequence of operations therefore includes an installation of the bridging element (FIG. 8*a*), the insertion of a cable connector designated by the general reference 70 which has, at its front part, a latch 78 carried by a latch lever which interacts with the opening 30 carried by the branch 13 of the bridging element. The cable connector 70 includes openings 72 for the male conductors 60, female contacts 73 and cable mounting lugs 74, 75. The bridging element is surrounded by an insulating jacket 71. The cable connector 70 is surrounded by a metallized plastic jacket 76 which forms its screen and which makes contact with the crooks 48 (see FIG. 1).

FIG. 8*c* shows more particularly the distribution of the mechanical functions when a traction force is exerted on the cable connector. The action force F and reaction force R which are generated at the site of the latch 78 are transmitted toward the screening plates 40 via the tongues 45 disposed in the grooves 20, then toward the male contacts 43 which retain the bridging element on the motherboard 1. It will be noted that the 90° folds 44 of the contact pads 42 enable the bridging element to be retained in place with a certain elasticity.

Furthermore, if a traction force is exerted on the male connector 3, the fixing action retransmitted by the screening plates 40 is added to the retention forces produced by the male contacts 60 inserted at 61 into the central branch 11.

Figure 9C:
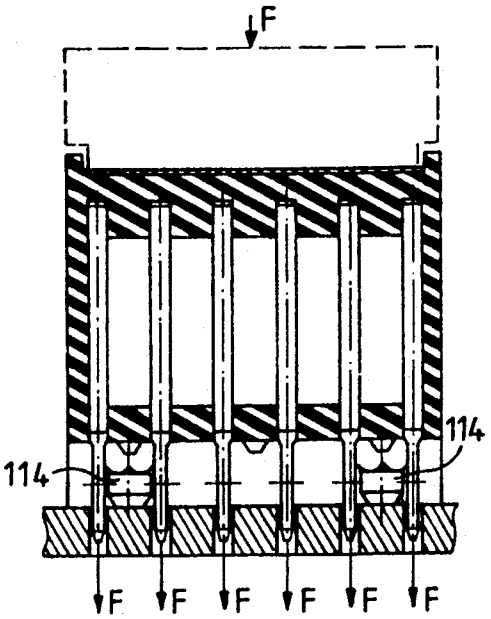
FIG. 9*c*, the sectional view along G—G of FIG. 9*a*.
Figure 9B:
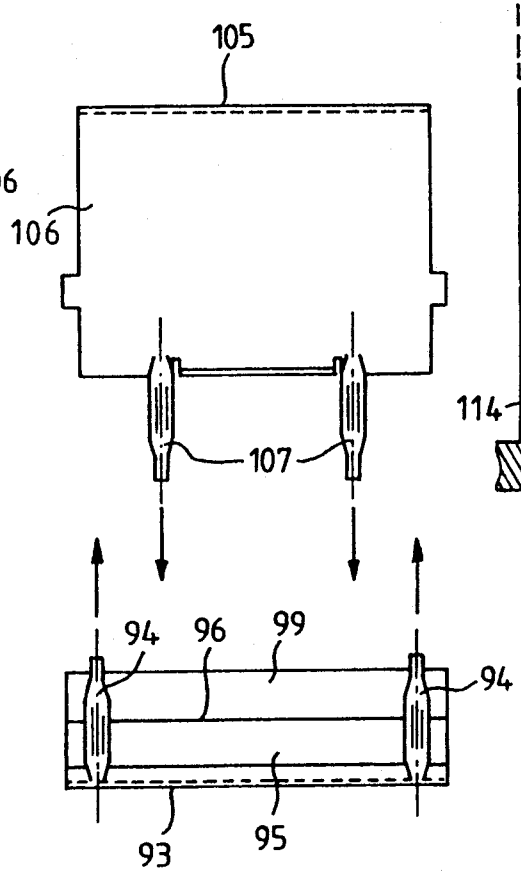
FIG. 9*b* representing the two parts of the screening element in side view.
Figure 9A:
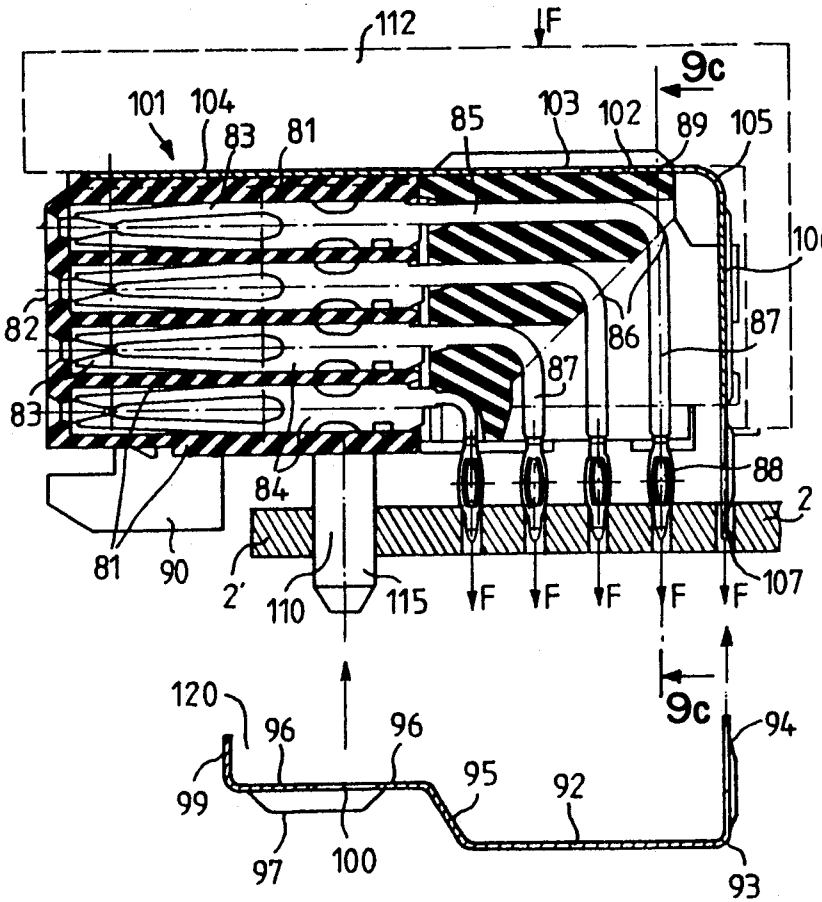
FIG. 9*a*, a connector for connecting between a male connector and a daughterboard at the time of its assembly with its two-part screening element.

FIGS. 9*a* to 9*c* show a connector for linkage between a male connector and a daughterboard 2. It includes a front insulating body 81 having openings in which female contacts 83 are disposed and are extended by the cylindrical conductors 85 forming a 90° elbow at 86 and having a rear part 8*e* prolonged by the forced-insertion male contacts 88. The cylindrical contacts 85, 86, 87 are embedded in a rear insulating block designated by the general reference 89. The insulating body 81 has, in the vicinity of the male contacts 88, a hot-deformable stud 110 having an end 115. Two centering studs 114 flank the deformable stud 110. The first screening element, designated by the general reference 91, includes a plane face 92 forming a cap for the projecting ends of the contacts 88. This cap 92 is prolonged at one end by forced-insertion contacts 94 which form with it a 90° angle (fold 93) and its second end by a profile inclined at 45°, 95°, which is prolonged by a plane face 96 including an opening 100 of diameter corresponding to that of the stud 110 in order to allow its ends 115 to pass. The opening 100 is flanked by two contact projections 97 intended to interact with the crooks 48. The projections 97 receive the ends of the centering studs 114. The plane surface 96 is prolonged by a spacer 99 forming a 90° angle with it, which thus defines a space 120 capable of receiving and sandwiching an end 2' of the daughterboard 2. The spacer 99 defines a space for surrounding and receiving the end of a daughterboard 2. A second cap, designated by the general reference 101, has two plane parts 102 and 106 connected by means of a 90° fold 105 so as to follow and to surround the path of the conductor elements of the connector. The plane part 106 is prolonged by forced-insertion contact 107 which fit together with the contacts 94 for good screening continuity. The contacts 94 and 107 are interconnected by conductors of the daughterboard 2. The distal end of the plane part 102 is prolonged by two lateral arms 104, the function of which is to permit and to retain a continuity of the ground contact until the main conductors have been disconnected.

Referring also to FIGS. 10*a* to 10*e*, the assembly is effected in the following manner: an L-shaped profiled tool, designated by the reference 112 matches the contour of the screen 100 and permits the insertion of its contacts 107 into the motherboard 2 at the same time as the contacts 88, without deforming the screening plate 101. During this operation, the centering studs 114 which surround the hot-deformable stud 110 are slightly forcibly inserted into the daughterboard 2 so as to retain the latter temporarily in place. Next, the screen 91 is installed by forcible insertion, into the corresponding openings of the daughterboard, of its contacts 94. The opening 100 is traversed by the end 115 of the stud 110. In order to forcibly insert its contacts 94 into the daughterboard 2, the screening plate 91 is also retained by a tool of corresponding shape which surrounds it and prevents its deformation.

Figures 10A, 10B, 10C, 10D, 10E:
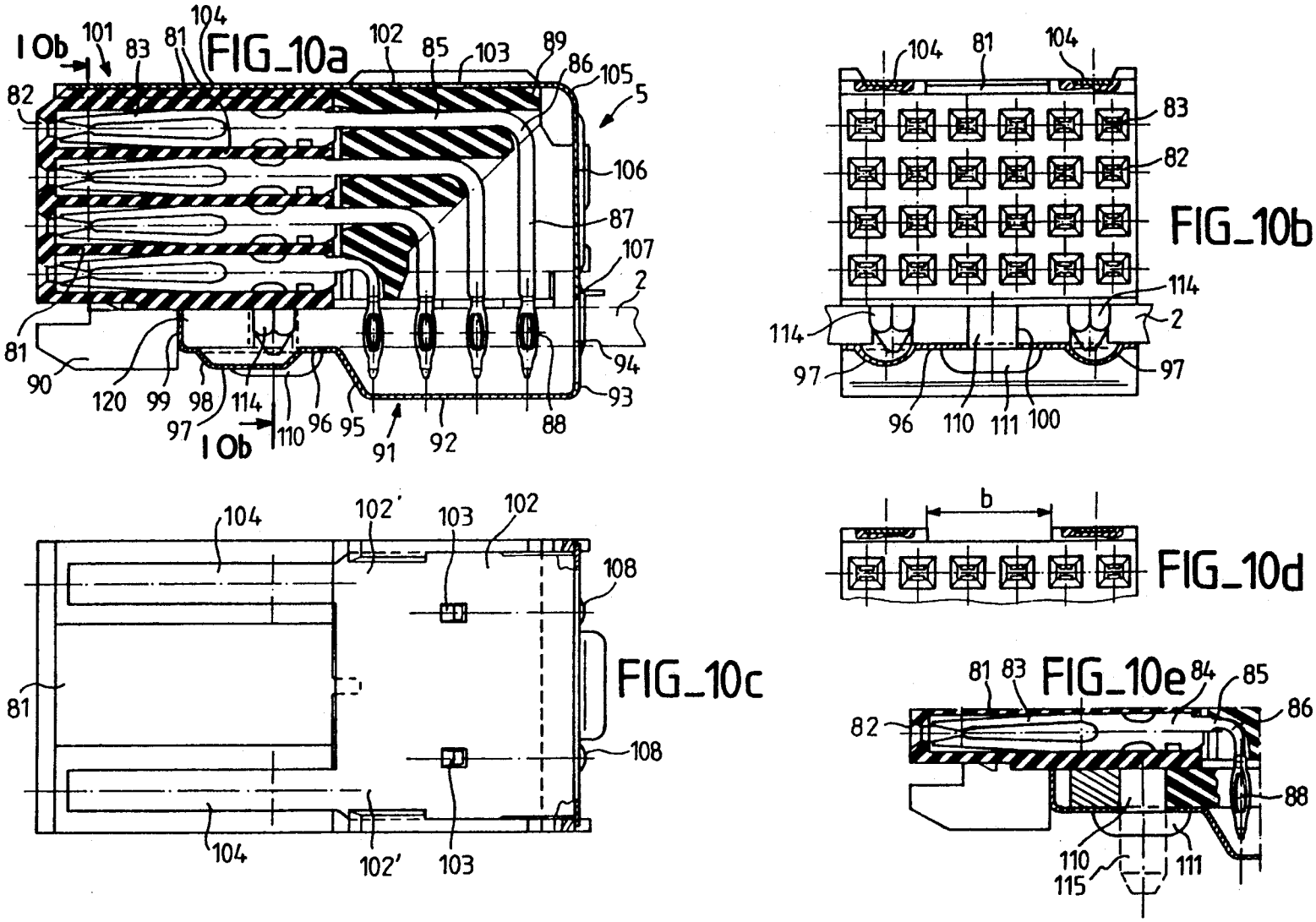
FIGS. 10*a* to 10*e*, respectively a longitudinal section of a connecting connector after assembling the elements shown in FIG. 9*a*, a sectional view along C—C of such an element, a plan view of such a connector, a partial sectional view of the front part of such a connector, and a partial sectional view showing the hot-deformable stud before and after deformation during the assembly of the connector.

Next the hot-deformation of the stud 110 is carried out, the assembly being retained temporarily in place, on the one hand, by the centering studs 114 and by fixing the plate 91 by means of its contacts 94. After deformation, the end 115 of the stud 110 assumes the shape of a flattened head 111 (FIGS. 10*b* and 10*e*). The centering studs 114 thus have a double function, namely, on the one hand, to produce good centering of the daughterboard independently of the deformations of the stud 110 and, on the other hand, to temporarily retain the latter in place during the operation of hot-deformation of the stud 110.

Figure 11B:
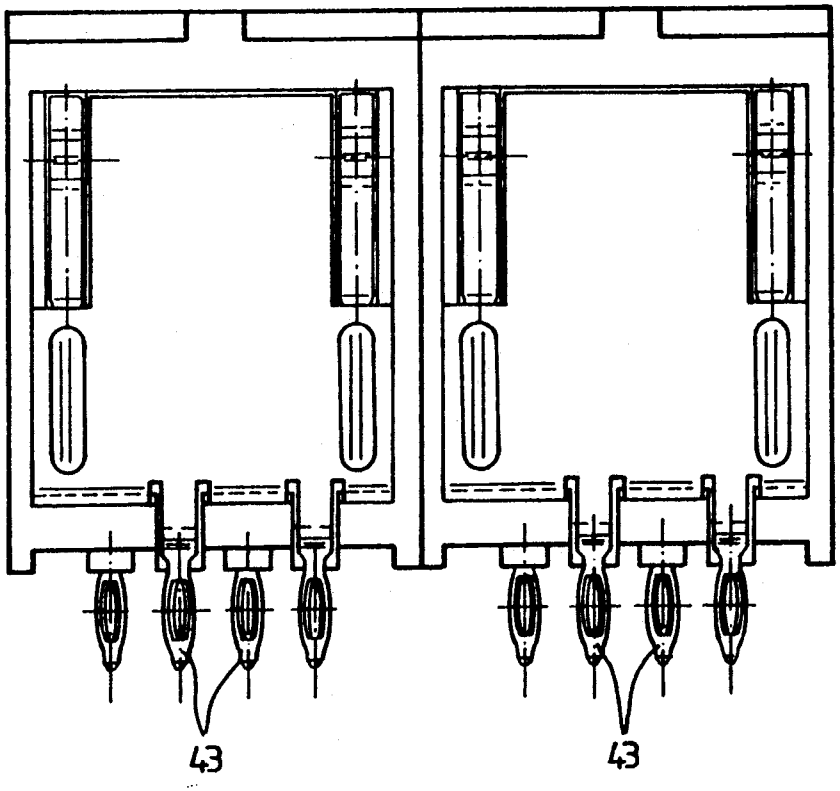
FIGS. 11*a*, 11*b* and 11*c*, in side view, respectively a connection element, two juxtaposed modular connection elements and four juxtaposed modular connection elements.
Figure 11A:
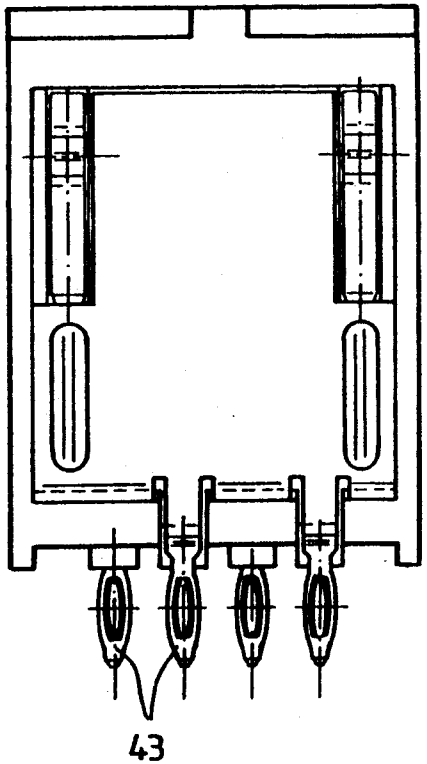
Figure 11C:
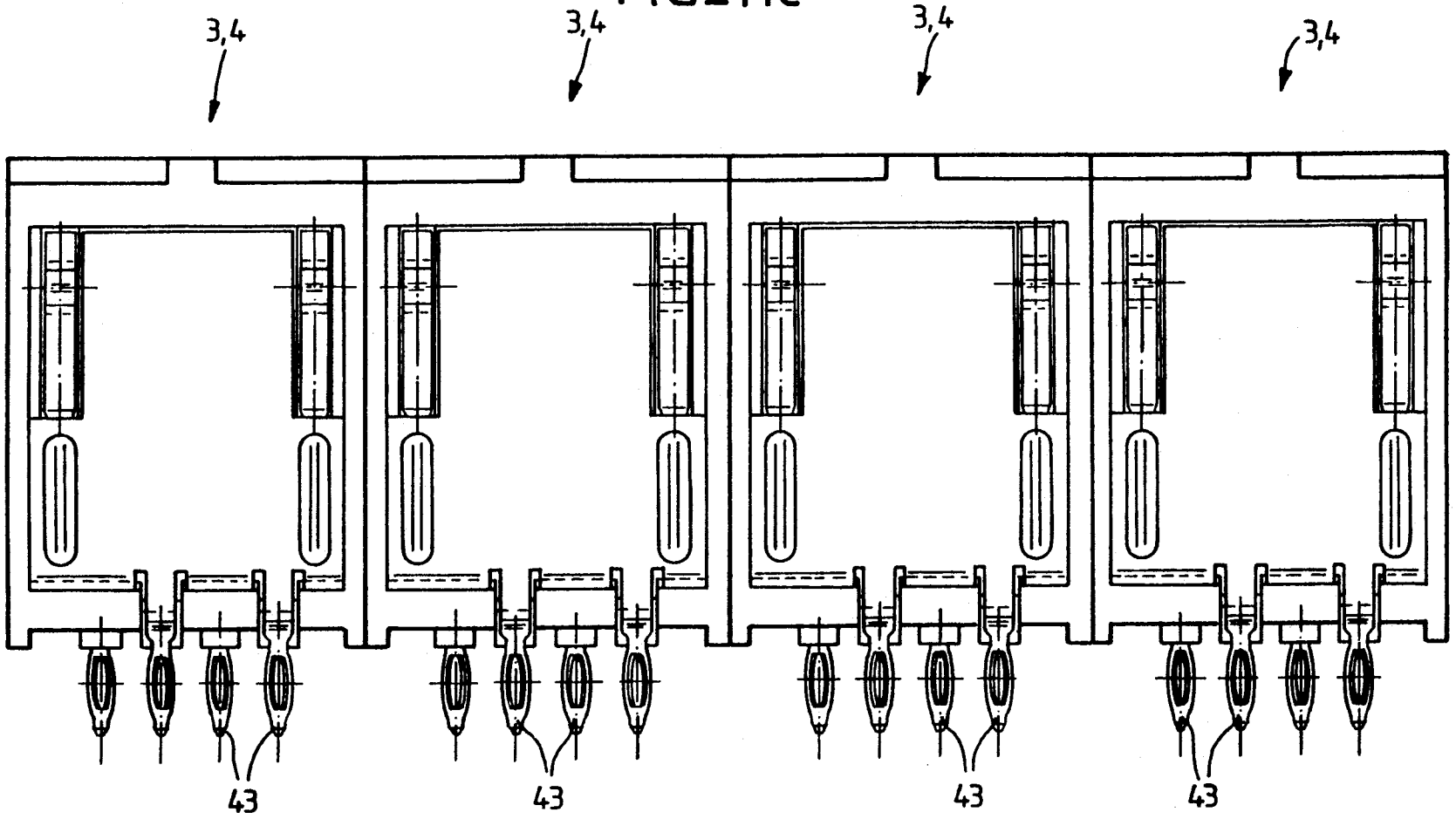

FIGS. 11*a* to 11*c* show the advantage of the modular connector according to the invention which may be used either individually (FIG. 11*a*) or side by side in pairs (FIG. 11*b*) or in a larger number, for example four (FIG. 11*c*)

We claim:

1. Modular electrical-connection element including an insulating body having a U-shaped cross section including a central branch (11) for receiving electrical contact elements and two lateral branches (12,13), said cross section having a width (1) equal to that of a module, characterized in that each lateral branch includes an electrically conductive screening element (40) extending over a major part of an outwardly directed surface of said lateral branch, said screening element including at least one means (46,48) for elastic electrical contact positioned on an inner face of said lateral branch and at least one means for electrical connection through said insulating body, said screening element (40) having a means (45) for retaining said screening element in position in the insulating body, at least in the direction of a pull-out substantially parallel to an axis of the U-shaped cross section.

2. Modular element according to claim 1, characterized in that said means for retaining in position includes at least one tongue (45) folded over by substantially 90° with respect to a plane of the screening element and interacting with at least one groove (20) of the insulating body.

3. Modular element according to claim 2, characterized in that said interaction is obtained by forcing each said tongue (45) into a corresponding groove (20).

4. Modular element according to claim 2, characterized in that each said groove (20) is disposed substantially at a junction (18) between the central branch (11) and one of said lateral branches (12, 13).

5. Modular element according to claim 1, characterized in that each said electrical connection means includes at least one connection tab (43) of the forcible mounting (press-fit) type.

6. Modular element according to claim 2, characterized in that each said electrical connection means (43) includes at least one connection tab (43) having an elbowed part (44) having two alternate bends and interacting with a corresponding limit stop (22) of the insulating body.

7. Modular element according to claim 6, characterized in that each of the screening elements have an edge adjoining the central branch and including a plurality of said electrical connection means (43) alternating with a plurality of said tongues (45).

8. Modular element according to claim 1, characterized in that at least one said screening element (40) extends over an outer face (32) of a corresponding one of said lateral branches (12, 13), which has an opening (17) arranged so as to permit said elastic electrical contact through an inner face (31) of said corresponding lateral branch.

9. Electrical connection device, characterized in that it includes a first assembly of said modular elements according to claim 1, which are mounted side by side firmly attached to a motherboard (1), at least by said electrical connection means (43).

10. Device according to claim 9, characterized in that the first assembly of said modular elements consists of bridging elements (4) for a cable connector, the bridging elements, being firmly attached to the motherboard (1) solely by said electrical connection means (43).

11. Device according to claim 10, characterized in that said device includes a second assembly of said modular elements consisting of male connectors (3) mounted back to back with the bridging elements (4) of the first assembly, the electrical connection means (43) of the corresponding modular elements of the first (4) and second (3) assemblies being fitted together.

* * * * *

UNITED STATES PATENT AND TRADEMARK OFFICE

CERTIFICATE OF CORRECTION

PATENT NO. : 5,277,624

DATED : JANUARY 11, 1994

INVENTOR(S) : PATRICK CHAMPION ET AL.

It is certified that error appears in the above-indentified patent and that said Letters Patent is hereby corrected as shown below:

On the title page, item [73] Assignee: should read

—FRAMATOME CONNECTORS INTERNATIONAL—

Signed and Sealed this

Sixth Day of December, 1994

*Attest:*

*Attesting Officer*

BRUCE LEHMAN

*Commissioner of Patents and Trademarks*